US005645387A

United States Patent [19]

Scalet et al.

[11] Patent Number: 5,645,387

[45] Date of Patent: Jul. 8, 1997

[54] METHOD AND APPARATUS FOR AFFIXING INSERTS WITHIN BOOKS ON A BINDING LINE

[75] Inventors: Frank Scalet, Warsaw; Joseph P. Berger; Hal B. Harting, both of Winona Lake; Anthony J. Majewski, Warsaw; Khrystal L. Neibert, Winona Lake; Lois C. Tucker; Judy E. Walters, both of Warsaw; Steven D. Weaver, Claypool, all of Ind.

[73] Assignee: R. R. Donnelley & Sons Company, Chicago, Ill.

[21] Appl. No.: 387,260

[22] Filed: Feb. 13, 1995

[51] Int. Cl.[6] ..... B42B 5/00

[52] U.S. Cl. ..... 412/1; 412/33; 412/35

[58] Field of Search ..... 412/35, 1, 8, 25, 412/28, 33

[56] References Cited

U.S. PATENT DOCUMENTS

| | | | |
|---|---|---|---|
| 2,366,064 | 12/1944 | Sieb | 412/35 |
| 5,232,324 | 8/1993 | Graushar . | |
| 5,295,775 | 3/1994 | Andjelic et al. | 412/35 X |

FOREIGN PATENT DOCUMENTS

| | | | |
|---|---|---|---|
| 3623462 | 1/1988 | Germany | 412/35 |
| 1516985 | 7/1978 | United Kingdom | 412/35 |

OTHER PUBLICATIONS

1–1 Photograph—*Family Circle* magazine, May 1971.
1–2 Photograph—*Family Circle* magazine, May 1971.
1–3 Photograph—*Family Circle* magazine, May 1971.
2–1 Photograph—View looking downstream with a carrier signature approaching an insert and feeder.
2–2 Photograph—View looking downstream with a carrier signature approaching an insert and feeder.
2–3 Photograph—View of an insert guide on the near side of the conveyor.
2–4 Photograph—View of a second guide detached and lying on the conveyor cover.
2–5 Photograph—View of the second guide installed with the black bar holding the center of the insert above the carrier signature and with a wire mounted to a magnet overlying the insert to hold it down to ensure bonding.

*Primary Examiner*—Willmon Fridie, Jr.
*Attorney, Agent, or Firm*—Marshall, O'Toole, Gerstein, Murray & Borun

[57] ABSTRACT

In order to ensure that inserts in a book or magazine will reach the intended recipient, a binding line includes a plurality of packer boxes along a binding line conveyor. The binding line can actuate at least some of the packer boxes to gather signatures from them in order to build groups of signatures into books. The binding line also includes a feeder for feeding at least one insert for association with all or specific ones of the books wherein the inserts are affixed within the books at a point along the binding line. In order to ensure that the inserts in the book or magazine will reach the intended recipient, the inserts may be directly affixed in the books, placed in envelopes that are affixed in the books, or placed in bags that are affixed in the books.

38 Claims, 4 Drawing Sheets

METHOD AND APPARATUS FOR AFFIXING INSERTS WITHIN BOOKS ON A BINDING LINE

FIELD OF THE INVENTION

The present invention relates generally to producing books on binding lines and, more particularly, to an improvement in associating inserts with books such that the inserts are affixed therein.

BACKGROUND OF THE INVENTION

In recent years, many large circulation periodicals have appeared which require rapid handling of portions of the periodicals consisting of signatures which are gathered for stitching, trimmed, bundled for minimum shipping costs, and shipped. A typical operation utilizes a multitude of packer boxes each of which receives signatures seriatim from a signature supply means, opens each signature, and drops the signatures successively straddling a gathering chain that runs in front of the packer boxes and carries the complete collection of gathered signatures to the stitcher. Moreover, because of the need for highly efficient plant operations, there have been constant efforts to increase the speed at which machines operate which have required the development of new techniques for handling the signatures at all stages of a binding process.

In addition to high speed operation, many large circulation periodicals and catalogs are now demanding a degree of flexibility that has been heretofore considered impossible. This is particularly true, for instance, where it is desired for the periodical or catalog to include one or more inserts that are significantly undersized in relation to the size of a signature or are otherwise of a different nature or construction than a signature but are to be included with the periodical or catalog. This is even more the case where the inserts are to be included by incorporation during operation of a binding line which must be done without significant reduction in a cyclic rate of operation which would otherwise decrease plant efficiency thereby increasing costs while possibly failing to achieve the most efficient use of manpower, equipment and plant space. Furthermore, since the need for handling such inserts is not subject to a single, well-defined criteria there is a natural reluctance to devote significant additional manpower and/or equipment to this problem.

In addition, if any specialized equipment is required, it must not take any considerable amount of space since space is almost always at a premium in most binding lines. It will also be appreciated that any special piece of equipment must not be extremely costly or difficult to utilize in a manner wherein it is capable of operating compatibly with the remainder of the equipment normally on the binding line. Furthermore, it would be highly desirable to be able to utilize most presently existing equipment with minimal modifications or other disruptions to existing procedures.

In the case of inserts, a typical procedure includes loosely feeding the inserts into a book or magazine after the signatures have been gathered and stitched. The inserts are typically fed into the book or magazine at one or more points along the binding line. Once this has been done, the book or magazine proceeds to the mail table where it is placed in a plastic-wrap or paper bag in order to be able to ensure that the inserts remain in place.

As will be appreciated, the shrink-wrap bag is required in order to be able to maintain the inserts in association with the book or magazine. They are otherwise loosely placed within the book or magazine and, during transport and mailing, the inserts can easily become separated or fall from the book or magazine. As a result, there is additional cost in terms of material, labor and operating efficiency involved in the step of applying a plastic-wrap or paper bag.

In view of the foregoing, and as will be appreciated by those skilled in the art, it would be highly desirable to be able to integrally associate inserts with a book or magazine. It would be particularly desirable to achieve this objective without the need to diminish normal binding line operating efficiencies or to otherwise disrupt the normal operation of a binding line while at the same time making it possible to eliminate the necessity for applying a shrink-wrap bag to each book or magazine. If this could be accomplished, the difficulty of choosing between the additional cost of the plastic-wrap or paper bag or the possible loss of the inserts during transport and mailing could be eliminated.

As is known, systems for the selective or demographic assembly of books or magazines and imprinting an address or personalized message are shown in commonly owned Abram et al. U.S. Pat. No. 3,899,165 and Riley et al. U.S. Pat. No. 4,121,818. This ability to achieve selective or demographic assembly of books or magazines has been still further developed as shown in other commonly owned patents such as Berger et al. U.S. Pat. Nos. 4,768,766 and 4,789,147 and Auksi U.S. Pat. No. 5,005,815, among others. Clearly, it would also be highly desirable to be able to selectively or demographically associate inserts with books or magazines on a binding line without disrupting normal binding line operations or requiring undue capital expenditures.

The present invention is directed to overcoming one or more of the foregoing problems and achieving one or more of the resulting objects.

SUMMARY OF THE INVENTION

It is therefore a principal object of the invention to provide an improvement in affixing an insert within a book on a binding line without damaging or additional folding of the book or insert. It is an additional object of the present invention to provide a binding line in which at least either a separate feeder or one of the packer boxes feeds an insert-carrying enclosure such as an envelope or a bag, or directly feeds an insert, for affixing within a book on a binding line. It is also an object of the invention to provide a method of binding which includes affixing an insert, an insert-containing envelope or an insert-containing bag within a book on a binding line.

Accordingly, the present invention is generally directed to a binding line for binding a book including a plurality of packer boxes along a binding line conveyor together with means for actuating at least some of the packer boxes. This causes signatures from the packer boxes to be gathered to build groups of signatures into the books. With this arrangement, the invention comprises the improvement of incorporating into the binding line means for feeding one or more different inserts for association with all or any specific ones of the books and means for affixing the insert or inserts within those books at a selected point on the binding line.

In one embodiment, the inserts are each contained in an insert-containing enclosure with each of the insert-containing enclosures advantageously comprising an envelope carrying at least one of the inserts therewithin. The feeder preferably causes the envelopes to be fed in a direction generally perpendicular to the direction of travel of the books on the binding line conveyor at a point located downstream of a stitcher which is downstream of the packer boxes. Still additionally, the affixing means advantageously comprises means for applying an adhesive to the envelope or book before the envelope is fed into the book to thereby affix one of the envelopes being fed by the feeder within all or any specific ones of each of the books on the binding line.

In another embodiment, the inserts are each contained in an insert-containing enclosure with each of the insert-containing enclosures advantageously comprising a bag having first and second sections one or both of which carry at least one of the inserts therewithin. The feeding means for the bags preferably comprises one or more of the plurality of packer boxes along the binding line, and the insert-carrying sections of the bag are preferably disposed generally on opposite sides of a centerline thereof with at least one of the sections having one or more inserts so as to be relatively balanced in weight. With this arrangement, the affixing means for the bags advantageously includes a stitcher located downstream of the packer boxes on the binding line to thereby stitch the bags together with the signatures comprising the books to affix the bags therewithin.

In still another embodiment, the feeding means advantageously comprises a feeder for holding a supply of the inserts and for feeding the inserts such that at least one of the inserts may be associated with all or any specific ones of the books on the binding line. This embodiment preferably incorporates the inserts directly into the book rather than incorporating an insert-containing enclosure such as an envelope or bag and, for this purpose, the affixing means preferably comprises a gluing station on the binding line for applying a glue to at least one of the inserts and books for releasably securing the inserts within the books. Still additionally, the feeder may advantageously include means for holding a supply of at least two different inserts and for feeding the inserts such that one of each of the inserts may be associated with all or any specific ones of the books on the binding line.

With the last mentioned arrangement, the binding line may include means for affixing one of each of the inserts together including a gluing station for applying a glue to at least one of the inserts as one of each of the inserts is fed for association with one of the books on the binding line.

In another respect, the present invention is directed to a method of binding a book by gathering signatures from a plurality of packer boxes on a binding line conveyor. The signatures are gathered by actuating at least some of the packer boxes to build groups of signatures into the books. According to the invention, the method includes the steps of feeding at least one insert for association with all or any specific ones of the books and affixing the insert within the book on the binding line.

As for other details of the invention, the insert-containing envelope embodiment preferably is such that each envelope carries at least one insert therewithin and the feeder causes the envelopes to be fed in a direction generally perpendicular to the direction of travel of the books on the binding line conveyor. The binding line conveyor is arranged to normally transport the books backbone first and the feeding means includes means upstream of the feeder for rotating the books 90° to cause a foredge of each of the books to face the feeder in order to be able to receive one of the envelopes. With this arrangement, the feeder advantageously includes at least two different feeding stations each being provided with a supply of envelopes containing a different insert and being selectively actuatable to associate an envelope containing a selected one or group of the inserts within all or specific ones of the books.

In the insert-containing bag embodiment, the bags are preferably such that each of the first and second insert-carrying sections of the bag each contain an insert therein with the insert-carrying sections of the bag being disposed generally on opposite sides of a centerline thereof. It is also particularly advantageous, as previously suggested, for the insert-carrying sections of the bag to each have one or more inserts so as to be relatively balanced at least in terms of weight. As so configured, the binding line preferably includes a specific one of the packer boxes for feeding at least two different bags each containing different inserts within the insert-carrying sections and being selectively actuatable to associate a bag containing selected ones of the inserts with each of the books.

With regard to the directly affixed insert embodiment, the feeder is preferably located downstream of the stitcher for feeding the inserts in a direction generally perpendicular to the direction of travel of the books on the binding line conveyor. The feeder advantageously includes means for holding a supply of at least two different inserts and for feeding one of each of the inserts such that either one or none of the inserts is associated with all or specific ones of the books on the binding line. More specifically, the feeder preferably has at least two feeding stations each holding a supply of a different insert to be fed and being selectively actuatable to associate a selected one or more of the inserts with all or specific ones of the book as desired for a specific application.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
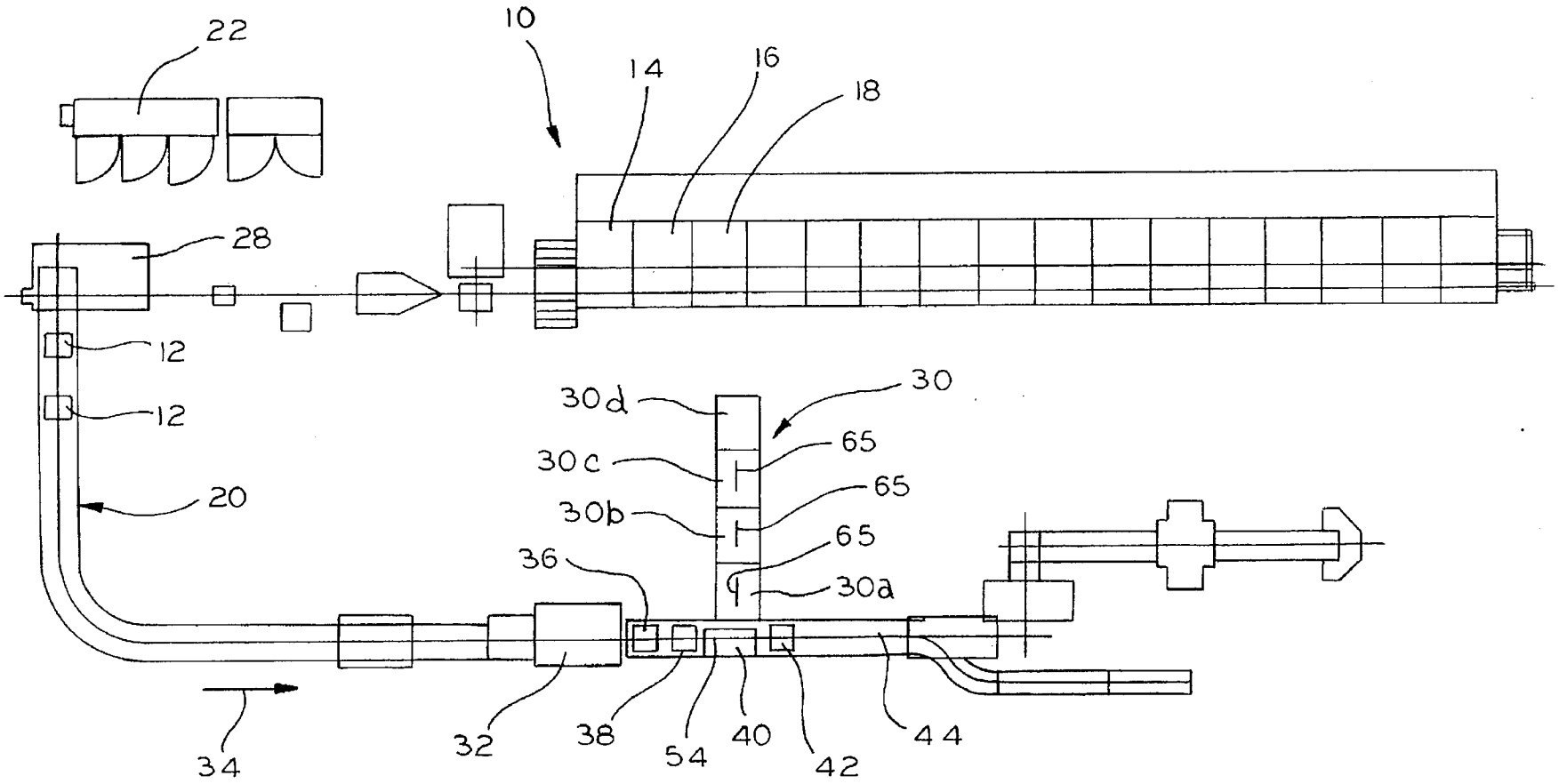
FIG. 1 is a diagrammatic view illustrating a binding line in accordance with one aspect of the present invention.

In the illustrations given, and with reference first to FIG. 1, the reference numeral 10 designates generally a binding line for binding a book 12 including a plurality of packer boxes 14, 16, 18, etc. along a binding line conveyor generally designated 20 together with means for actuating at least some of the packer boxes such as the logic panel 22. The logic panel 22, which may be conventional and of a type well known in the art, is adapted to actuate at least some of the packer boxes such as 14, 16, 18, etc. to gather conventional signatures (not shown) to build groups of signatures into the books 12 by means of selective or demographic assembly and addressing. With this arrangement for the binding line 10 as generally described, the present invention specifically comprises the improvement of means for feeding at least one insert for association with all or specific ones of the books 12 and means for affixing the insert within the book at a point along the binding line 20.

Figure 6:
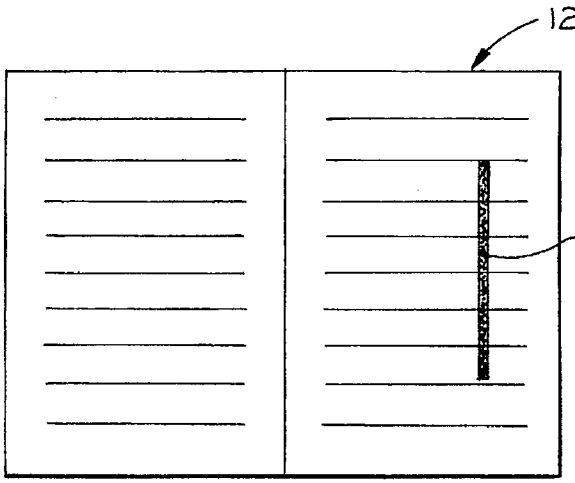
FIG. 6 is a plan view of the books of FIGS. 3 and 5 to show a glue stripe before the envelope or inserts are affixed therein.
Figure 3:
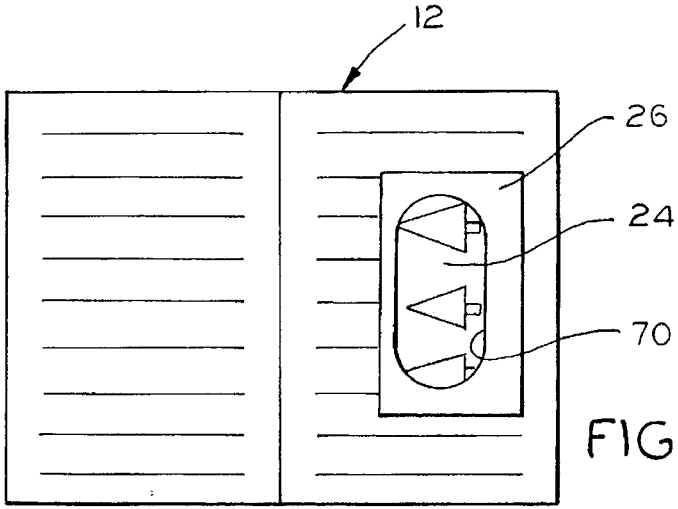
FIG. 3 is a plan view of a book which has been opened to show an insert-carrying envelope which has been affixed within the book.

In one embodiment, and referring to FIGS. 3 and 6, the inserts such as 24 are each contained in an insert-containing enclosure 26 each of which advantageously comprises an envelope carrying at least one of the inserts 24 therewithin. The binding line 10 will be understood to include a conventional stitcher 28 downstream of the packer boxes 14, 16, 18, etc. and the feeding means preferably includes a feeder 30 downstream of the stitcher 28 and, preferably downstream of the conventional trimmer 32 for feeding the envelopes 26 in a direction generally perpendicular to the direction of travel of the books 12 on the binding line conveyor 20 as represented by the arrow 34. Typically, the binding line conveyor 20 will transport the books 12 backbone first at a point downstream of the stitcher 28, and the binding line 10 will include a conventional book kicker 36 upstream of the feeder 30 for rotating the books 12 90°.

In this manner, the kicker 36 can cause the foredge of each of the books 12 to face the feeder 30 for receiving one of the envelopes 26 which are being fed by the feeder 30 generally perpendicular to the binding line conveyor 20. The binding line conveyor 20 will also be understood to normally transport the books 12 in a generally horizontal plane, i.e., relatively flat, and the feeder may then advantageously include means for opening the books 12 such as a vacuum opener 38 which may cause the books 12 to be opened and maintained open by an elevated ramp 40 such that the feeder 30 may feed the envelopes 26 one-at-a-time into the books 12 at a point downstream of the trimmer 32 on the binding line 10 where the envelopes 26 will not be susceptible to being sliced open by the trimmer. As also shown, the binding line 10 may then be provided with another kicker 42 downstream of the feeder 30 to reorient the books 12 to once again undergo backbone first travel along the binding line conveyor 20 through the mail table section 44.

Figure 2:
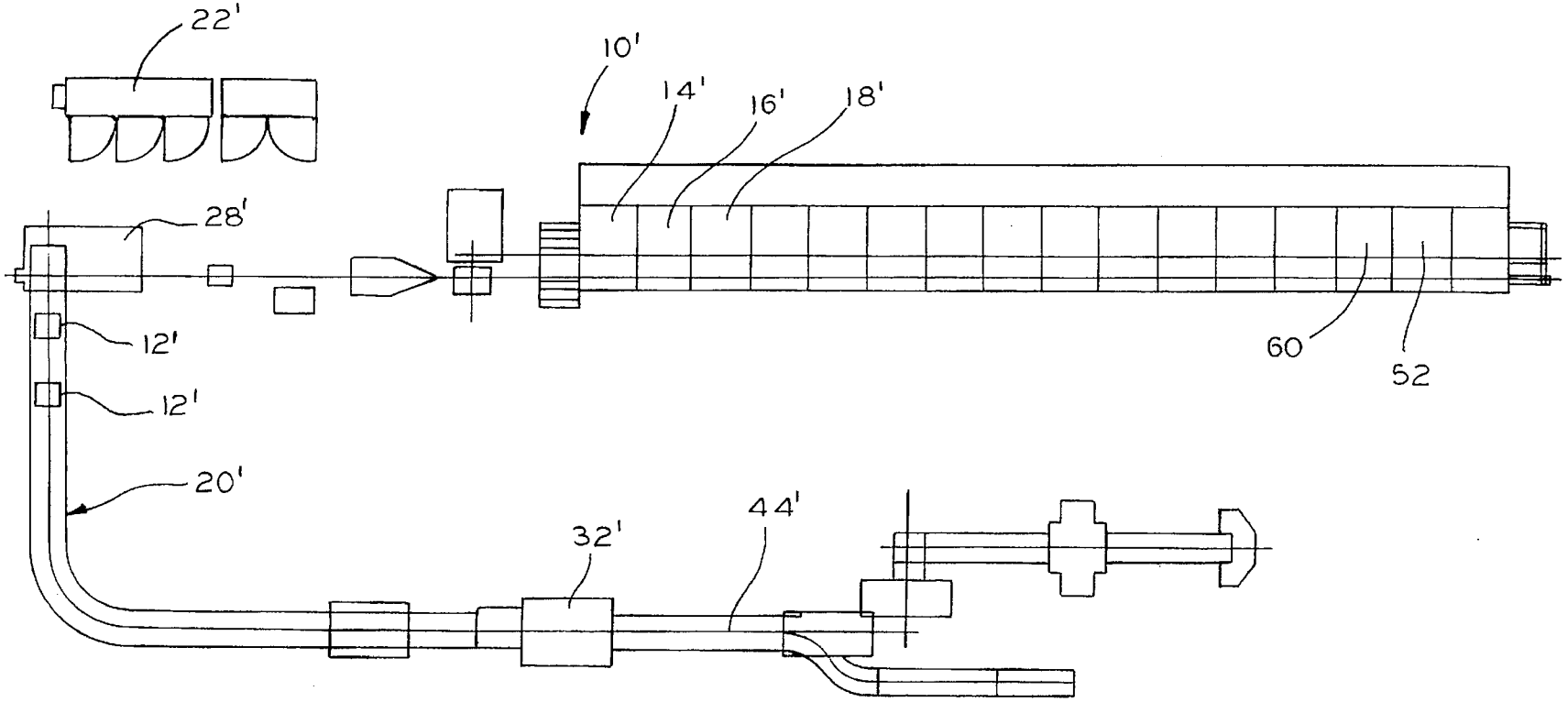
FIG. 2 is a diagrammatic view illustrating a binding line in accordance with another aspect of the present invention.
Figure 4:
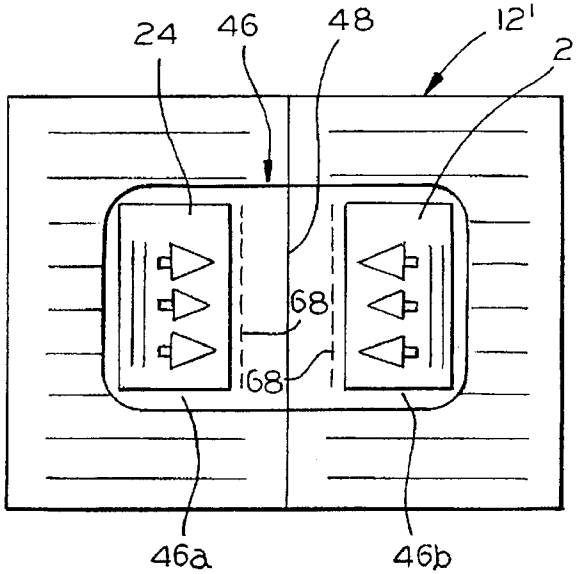
FIG. 4 is a plan view of a book which has been opened to show an insert-carrying bag which has been affixed within the book.
Figure 7:
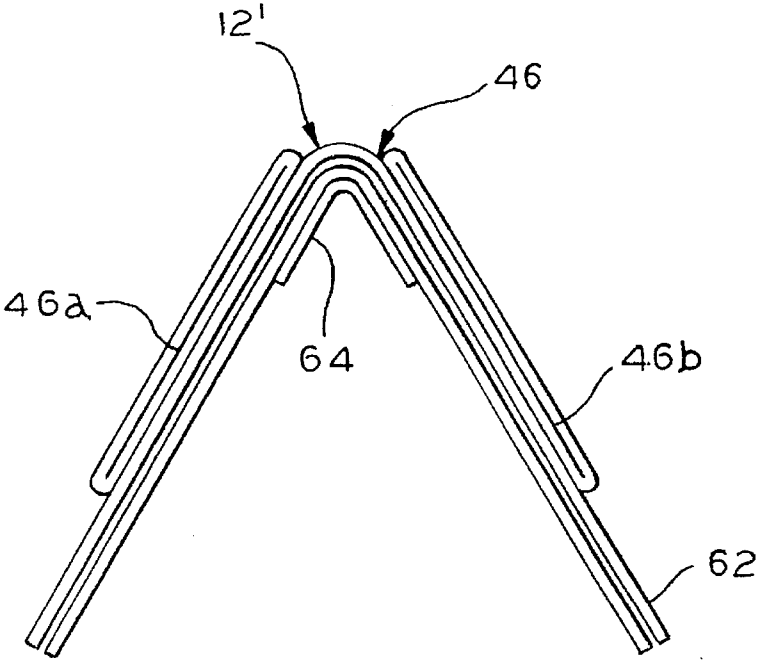
FIG. 7 is an end view of the book of FIG. 4 being gathered on the binding line before the book has been stitched.

Referring now to FIGS. 2, 4 and 7, the binding line 10' is essentially identical to the binding line 10 with the exception of the elimination of the feeder 30, kicker 36, vacuum opener 38, elevated ramp 40, and kicker 42. The binding line 10' will thus be seen to include a plurality of packer boxes 14', 16', 18', etc. disposed along the binding line conveyor 20', a logic panel 22' for controlling the operation of the binding line 10', a stitcher 28', a trimmer 32', and a mail table section 44'. As indicated in connection with the binding line 10, these components of the binding line 10' will all be understood to be conventional and, thus, it is unnecessary to describe them in detail which would only serve to unduly lengthen the description.

As shown in FIGS. 4 and 7, the inserts 24 are each contained in an insert-containing enclosure 46 each of which comprises a bag having first and second sections **46*a* and 46*b* one or both carrying at least one of the inserts 24 therewithin. It will be appreciated that the inserts 24 have been shown to be identical in FIG. 4 whereas in an actual production run it would be far more likely for the inserts 24 to be entirely different since there would usually be no reason or purpose in providing the recipient of one of the books such as 12' with two identical inserts. In any event, and as shown in FIGS. 4 and 7, the first and second insert-carrying sections 46*a* and 46*b* are advantageously disposed so as to be positioned generally on opposite sides of a centerline 48 of the bag 46** in order to achieve a balanced form.

In this embodiment, and referring to FIG. 2, the feeding means advantageously comprises one of the plurality of packer boxes such as 52 disposed along the binding line 10'. It will also be appreciated that the stitcher 28' preferably comprises suitable affixing means for affixing the bags such as 46 downstream of the packer boxes 14', 16', 18', etc. on the binding line 10'. In other words, and referring to FIGS. 2 and 4, the bags such as 46 can be affixed by stitching them into the books 12' along with the signatures that are gathered for the purpose of forming the books 12'.

Figure 5:
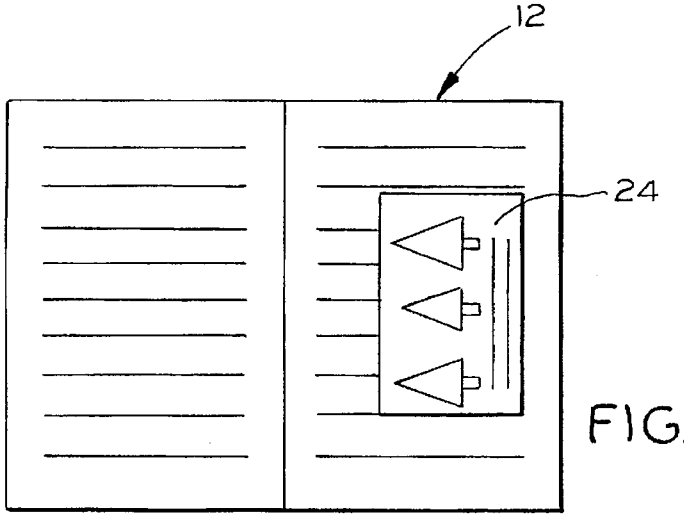
FIG. 5 is a plan view of a book which has been opened to show one or more inserts which have been affixed therein.
Figure 8:
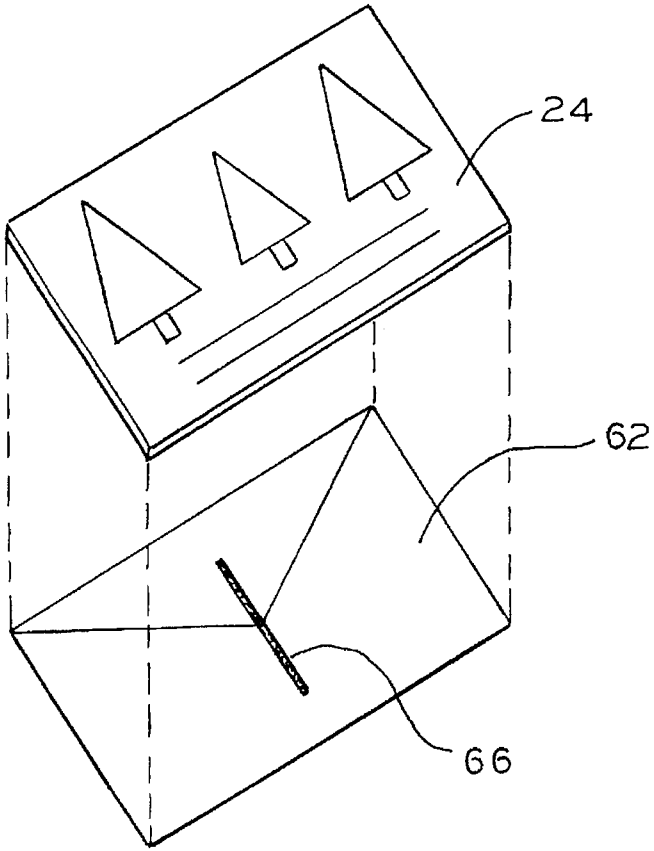
FIG. 8 is an exploded perspective view of the inserts of FIG. 5 before they have been affixed to the book shown therein.

Referring now to FIGS. 1, 5 and 8, the feeder 30 may also be adapted to directly hold a supply of the inserts 24 and to feed the inserts 24 such that at least one of the inserts 24 may be associated with all or specific ones of the books 12 on the binding line 10. The affixing means for either this embodiment or the embodiment in which the inserts 24 are carried in the envelopes 26, comprises a gluing station as at 54 on the binding line 10 for applying a glue strip or line as at 56 to at least one of the inserts 24 and books 12 and, preferably, to the books 12 as shown in FIG. 6, for releasably securing the inserts 24 within the books 12. In this connection, the glue as at 56 may advantageously comprise a hot melt glue of a type that is readily available and known for its capability of releasably securing one paper product to another paper product without causing damage to either.

As discussed in connection with feeding the envelopes 26, the feeder 30 may be suitably adapted to directly feed the inserts 24 in a direction generally perpendicular to the direction of travel of the books 12 on the binding line conveyor 20. As previously noted, the binding line conveyor 20 normally transports the books 12 backbone first and may again include means upstream of the feeder 30 such as the kicker 36 for rotating the books 12 90° to cause a foredge of each of the books 12 to face the feeder 30 for receiving one of the inserts 24. Also, once again, the binding line conveyor 20 may include a vacuum opener 38, an elevated ramp 40, and a kicker 42 for again rotating the books 12 90° so that they are transported through the mail table section 44 backbone first. In other words, the feeder 30 may simply be adapted to directly feed the inserts 24 or the envelopes 26 containing the inserts 24 for association with the books 12 depending upon the technique that is desired for a particular application.

In either case, the envelope 26 containing the insert 24 or just the insert 24 itself is fed into the book 12 so as to be positioned such that it overlies the glue strip 56. The tackiness of the glue strip 56 will retain the envelope 26 or the insert 24 in position in contact with the glue strip 56 as the book 12 is closed after it finishes passing over the elevated ramp 40 and, when the books 12 are ultimately stacked at a downstream location for mailing, the weight of the stack will cause firm adherence of the envelope 26 or the insert 24 to the glue strip 56 until it is peeled away by the consumer. From the foregoing, the advantages of the present invention will be apparent inasmuch as it is no longer necessary to utilize a plastic-wrap or paper bag to maintain loose inserts within a book that is to be mailed.

Referring once again to FIG. 1, the feeder 30 will be seen to include at least two and preferably a plurality of different feeding stations which, solely for purposes of illustration, have been designated as **30*a*–30*d*. Each of the feeding stations 30*a*–30*d* are preferably provided with a supply of envelopes 26 each containing a different insert such as, but each differing from, the insert 24, at each of the different feeding stations 30***a*–30*d*. With this arrangement, the feeding stations 30*a*–30*d* are selectively actuatable in response to a signal from the logic panel 22 to associate an envelope 26 containing a selected one of the inserts such as 24 with all or specific ones of the books 12.

In like fashion, and referring specifically to FIG. 2, the binding line 10' may include one or more separate packer boxes such as 52 and 60 dedicated for the purpose of feeding at least two different versions of bags such as 46. By way of example, the packer box 52 may feed the bags 46 containing the inserts such as 24 within the insert-carrying sections 46*a* and 46*b* whereas the packer box 60 may feed a different bag similar to 46 but containing entirely different inserts within its insert-carrying sections corresponding to 46*a* and 46*b*. With this arrangement, the packer boxes 52 and 60 are selectively actuatable in response to a signal from the logic panel 22' to associate a bag such as 46 containing selected ones of the inserts such as 24 with all or specific ones of the books 12'.

With regard to this embodiment, and referring specifically to FIGS. 4 and 7, it will be appreciated that it is desirable to balance the inserts within each of the first and second insert-carrying sections 46*a* and 46*b*. It is, of course, not necessary that they be balanced precisely and equally in weight but, on the other hand, they should be relatively balanced in order to maintain the bag 46 in position straddling the other signatures as at 62 on the portion of the binding line conveyor 20 comprising the gathering chain 64.

As shown in FIGS. 4 and 7, the bag 46 comprises the innermost signature of the book 12' although this is, of course, not essential and has been done purely for illustration purposes. It does, however, clearly illustrate the bags 46 and their placement within a book 12'.

Referring to FIGS. 1, 5 and 8, the feeder 30 may advantageously be configured to hold a supply of two or more different inserts such as those designated 24 and 62 (see FIG. 8). The controlling factor on the total number of inserts such as 24 and 62 will be the total number of feeding stations such as 30*a*–30*d* and, in any event, the feeding stations such as 30*a*–30*d* may be selectively actuatable in response to a signal from the logic panel 22 to feed one or more of the inserts such as 24 and 62 for association with and affixing in all or specific ones of the books 12. As shown in FIG. 8, the inserts 24 and 62 comprise a card and an envelope which may be fed by the feeding stations 30*a* and 30*b* for association with and affixing in each of the books 12 on the binding line 10.

As shown in FIG. 1, the binding line 10 may then also include means for affixing the inserts 24 and 62 together which may advantageously be done before they are fed into the book 12. This may include a gluing station such as 65 in which case the envelope such as 62 may be fed by the feeding station 30*b*, the gluing station as at 65 may apply a glue strip as at 66, the card 24 may be fed onto the envelope 62 at the feeding station 30*a* so as to come into contact with the glue strip 66, and the composite card 24/envelope 62 may be fed into the book 12 for contact with the glue strip 56 (see FIG. 6) to be positioned within the book 12 substantially as shown in FIG. 5. As will be appreciated, the card 24 and envelope 62 represent only one of a multitude of examples of the possibilities that are available with the invention as described hereinabove.

In a similar manner, and as alluded to above, the feeder 30 may be utilized by providing envelopes 26 with different inserts to be fed from at least two different feeding stations such as 30*a* and 30*b*. The envelopes such as 26 may then be fed by selectively actuating the feeding stations 30*a* and 30*b* to associate a selected one of the envelopes and inserts with all or specific ones of the books 12. Of course, the exact number of different versions of envelopes and inserts that can be fed by the feeder 30 is limited only by the number of feeding stations such as 30*a*–30*d* which are provided.

As will be appreciated, the inserts such as 24 may take any of a wide variety of different forms quite apart from the specific card that has been illustrated in FIGS. 3–5 and 8. The actual inserts such as 24 may be visible through front windows such as 70 in the envelopes 26 or may be visible by forming the bags 46 of a clear plastic film and, of course, the inserts 24 as shown in FIG. 5 will be directly visible due to their direct placement into the books 12. While not in any way so limited, the inserts such as 24 may comprise a visually attractive gift such as a free card having dramatic graphics which may be accompanied by an envelope such as 62 in any of the embodiments illustrated in FIGS. 3–5.

As other alternatives, the inserts such as 24 may take the form of advertising and/or order forms and/or sheets for any of a wide variety of different products. With the visibility of the inserts such as 24, and particularly where the insert is visually attractive, the recipient of the book 12 will be drawn to it and tempted to open it or otherwise gain access to it for inspection purposes. Since the recipient will be attracted to the insert such as 24 due to its visibility in any of the embodiments, there is a natural incentive to remove the insert such as 24 which is easily accomplished by reason of the use of the hot melt glue as at 56 in the embodiments of FIGS. 3 and 5.

With regard to the bag 46, the first and second insert-carrying sections 46*a* and 46*b* may have perforations as at 68 or other means for gaining access to the first and second insert-carrying sections 46*a* and 466*b* to remove the inserts such as 24.

As mentioned above, the binding lines 10 and 10' may advantageously be equipped to have the capability for performing selective or demographic binding which is, of course, something that is well known by those skilled in the art. Thus, the details of this type of binding need not be further described in any detail herein. However, in line with this capability, it is possible to take advantage of the availability of feeding different versions of inserts utilizing the embodiments of the invention to different recipients on the basis of demographics or the like.

From the foregoing, it is believed that the advantages inherent in the present invention will be clearly appreciated. The insert-carrying techniques of the present invention, as well as the binding line and method of binding that have been described above, represent a considerable advancement over the prior art. As a result, the present invention provides a versatility in binding lines that has heretofore been entirely unknown.

While in the foregoing there have been set forth preferred embodiments of the invention, it will be appreciated that the details herein given may be varied by those skilled in the art without departing from the true spirit and scope of the appended claims.

We claim:

1. In a binding line for binding a book including a plurality of packer boxes along a binding line conveyor together with means for actuating at least some of said packer boxes to gather signatures from said packer boxes to build groups of signatures into said books, the improvement comprising:

means for feeding at least one insert for association with all or specific ones of said books;

means for affixing each of said inserts to a signature within one of said books at a point along said binding line;

said inserts each being contained in an insert-containing enclosure comprising an envelope carrying at least one of said inserts therewithin;

said binding line including a stitcher downstream of said packer boxes and said feeding means including a feeder downstream of said stitcher for feeding said envelopes in a direction generally perpendicular to the direction of travel of said books on said binding line conveyor.

2. The binding line of claim 1 wherein said binding line conveyor normally transports said books backbone first and said feeding means includes a feeder and means upstream of said feeder for rotating said books 90° to cause a foredge of each of said books to face said feeder for receiving one of said envelopes.

3. The binding line of claim 1 wherein said binding line conveyor normally transports said books in a generally horizontal plane and said feeding means includes means for opening said books and a feeder for feeding said envelopes one-at-a-time into said books at a point downstream of a trimmer on said binding line.

4. The binding line of claim 1 wherein said inserts are each contained in an insert-containing enclosure each of which comprises a bag having first and second sections with one or both carrying at least one of said inserts therewithin.

5. The binding line of claim 4 wherein said first and second insert-carrying sections are disposed generally on opposite sides of a centerline of said bag.

6. The binding line of claim 4 wherein said feeding means for said bag comprises one of said plurality of packer boxes along said binding line.

7. The binding line of claim 4 wherein said affixing means for said bag includes a stitcher downstream of said packer boxes on said binding line.

8. The binding line of claim 1 wherein said affixing means comprises a gluing station on said binding line for applying a glue to said envelopes or said books for releasably securing said envelopes within said books.

9. In a binding line for binding a book including a plurality of packer boxes along a binding line conveyor together with means for actuating at least some of said packer boxes to gather signatures from said packer boxes to build groups of signatures into said books, the improvement comprising:

means for feeding a plurality of insert-containing enclosures one-at-a-time for association with said books, said insert-containing enclosures each comprising an envelope carrying at least one insert therewithin;

said binding line including a stitcher downstream of said packer boxes and said feeding means including a feeder located downstream of said stitcher, said feeder causing said envelopes to be fed in a direction generally perpendicular to the direction of travel of said books on said binding line conveyor; and means for affixing one of said envelopes being fed by said feeder within all or specific ones of said books on said binding line, said affixing means comprising means for applying a glue to said envelope or said book before said envelope is fed into said book.

10. The binding line of claim 9 wherein said binding line conveyor normally transports said books backbone first and said feeding means includes means upstream of said feeder for rotating said books 90° to cause a foredge of each of said books to face said feeder for receiving one of said envelopes.

11. The binding line of claim 10 wherein said binding line conveyor normally transports said books in a generally horizontal plane and said feeding means includes means for opening each of said books for receiving one of said envelopes at a point downstream of a trimmer on said binding line.

12. The binding line of claim 11 wherein said binding line conveyor normally transports said books to a mail table downstream of said feeder and including means downstream of said feeder for rotating said books 90° to cause said binding line conveyor to once again transport said books backbone first.

13. The binding line of claim 9 wherein said feeder includes at least two different feeding stations each being provided with a supply of envelopes containing a different insert and being selectively actuatable to associate an envelope containing a selected one of said inserts with all or specific ones of said books.

14. In a binding line for binding a book including a plurality of packer boxes along a binding line conveyor together with means for actuating at least some of said packer boxes to gather signatures from said packer boxes to build groups of signatures into said books, the improvement comprising:

means for feeding a plurality of insert-containing enclosures one-at-a-time for association with said books, said insert-containing enclosures each comprising a bag having first and second insert-carrying sections at least one of which contains an insert therein, said feeding means for said bag comprising one of said plurality of packer boxes along said binding line; and means for affixing one of bags within all or specific ones of said books on said binding line.

15. The binding line of claim 14 wherein said insert-carrying sections of said bag are disposed generally on opposite sides of a centerline thereof.

16. The binding line of claim 14 wherein said affixing means for said bag includes a stitcher downstream of said packer boxes on said binding line.

17. The binding line of claim 14 wherein said insert-carrying sections of said bag each have one or more inserts so as to be relatively balanced in weight.

18. The binding line of claim 14 including a separate one of said packer boxes for feeding at least two different bags each containing different inserts within said insert-carrying sections and being selectively actuatable to associate a bag containing selected ones of said inserts with all or specific ones of said books.

19. In a binding line for binding a book including a plurality of packer boxes along a binding line conveyor together with means for actuating at least some of said packer boxes to gather signatures from said packer boxes to build groups of signatures into said books, the improvement comprising:

means for feeding at least one insert for association with all or specific ones of said books comprising a feeder for holding a supply of said inserts and feeding said inserts such that at least one of said inserts is associated with all or specific ones of said books on said binding line;

said binding line including a stitcher downstream of said packer boxes and said feeder being located downstream of said stitcher for feeding said inserts in a direction generally perpendicular to the direction of travel of said books on said binding line conveyor; and means for affixing said insert within said book at a point along said binding line comprising a gluing station on said binding line for applying a glue to said insert or said book for releasably securing said inserts within said books.

20. The binding line of claim 19 wherein said binding line conveyor normally transports said books backbone first and including means upstream of said feeder for rotating said books 90° to cause a foredge of each of said books to face said feeder for receiving one of said inserts.

21. The binding line of claim 19 wherein said binding line conveyor normally transports said books in a generally horizontal plane and said feeding means includes means for opening said books such that said feeder can feed said inserts one-at-a-time into said books at a point along said binding line.

22. The binding line of claim 19 wherein said feeder includes means for holding a supply of at least two different inserts and feeding one of each of said inserts such that at least one of each of said inserts is associated with all or specific ones of said books on said binding line.

23. The binding line of claim 22 including means for affixing said one of each of said inserts together including a gluing station for applying a glue to one of said inserts as said one of each of said inserts is fed for association with all or specific ones of said books on said binding line.

24. The binding line of claim 19 wherein said feeder includes at least two feeding stations each holding a supply of a different insert to be fed and being selectively actuatable to associate a selected one or more of said inserts with all or specific ones of said books.

25. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with all or specific ones of said books being carried in an envelope to be fed for association therewith; and affixing each of said envelopes to a signature within one of said books at a point along said binding line;

said feeding step including feeding said envelopes downstream of a stitcher in a direction generally perpendicular to the direction of travel of said books on said binding line conveyor.

26. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with all or specific ones of said books being carried in an envelope to be fed for association therewith; and.

affixing each of said envelopes to a signature within one of said books at a point along said binding line;

said feeding step including first rotating each of said books by 90° from a backbone first to a backbone parallel direction of travel for receiving one of said envelopes through a foredge thereof.

27. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with all or specific ones of said books being carried in an envelope to be fed for association therewith; and affixing each of said envelopes to a signature within one of said books at a point along said binding line;

said affixing step including applying a glue to each of said envelopes or books as said envelopes are being fed for association with said books for affixing said envelopes within said books on said binding line.

28. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with all or specific ones of said books being carried in an envelope to be fed for association therewith; and affixing each of said envelopes to a signature within one of said books at a point along said binding line;

said feeding step including said envelopes from at least two different feeding stations each being provided with different inserts and selectively actuating said feeding means to associate a selected one of said envelopes and said inserts with all or specific ones of said books.

29. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with said books being carried in a bag having first and second insert-carrying sections one or both of which carry at least one insert therewithin to be fed for association therewith; and affixing each of said bags to a signature within one of said books at a point along said binding line;

each of said bags being such that said first and second insert-carrying sections are disposed generally on opposite sides of a center line of said bag.

30. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with said books being carried in a bag having first and second insert-carrying sections one or both of which carry at least one insert therewithin to be fed for association therewith; and affixing each of said bags to a signature within one of said books at a point along said binding line;

said feeding step including feeding said bags from one of said plurality of packer boxes by actuating said packer box to include said bag with said signatures being built into said book on said binding line conveyor.

31. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with said books being carried in a bag having first and second insert-carrying sections one or both of which carry at least one insert therewithin to be fed for association therewith; and affixing each of said bags to a signature within one of said books at a point along said binding line;

said affixing step including passing each of said books being built of said signatures and said bag through a stitcher downstream of said packer boxes on said binding line to stitch said bag together with said signatures.

32. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with said books being carried in a bag having first and second insert-carrying sections one or both of which carry at least one insert therewithin to be fed for association therewith; and affixing each of said bags to a signature within one of said books at a point along said binding line;

each of said bags being provided with one or more inserts in each of said first and second insert-carrying sections so as to be relatively balanced in weight.

33. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said at least one insert fed for association with said books being carried in a bag having first and second insert-carrying sections one or both of which carry at least one insert therewithin to be fed for association therewith; and affixing each of said bags to a signature within one of said books at a point along said binding line;

said feeding step including said bags from at least two different feeding stations each being provided with different inserts and selectively actuating said feeding stations to associate a selected one of said bags and inserts with all or specific ones of said books.

34. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said feeding step including providing at least two separate feeding stations each holding a supply of a different insert to be fed such that one or more of said inserts can be associated with all or specific ones of said books; and affixing each of said inserts to a signature within one of said books at a point along said binding line.

35. The binding method of claim 34 wherein said affixing step includes at least applying a glue for releasably securing at least one of said inserts fed from at least one of said feeding stations within all or specific ones of said books on said binding line.

36. The binding method of claim 35 including the step of opening said books to receive said inserts and wherein said affixing step includes applying said glue to said books and feeding at least one of said inserts to be positioned on said glue.

37. The binding method of claim 36 wherein said feeding step includes feeding at least two different inserts for associating with one of said books and said affixing step includes applying a glue for releasably securing said inserts together before said inserts are associated with said one of said books.

38. In a method of binding a book by gathering signatures from a plurality of packer boxes onto a binding line conveyor, said signatures being gathered by actuating at least some of said packer boxes to build groups of signatures into said books, the improvement in binding line operation comprising:

feeding at least one insert for association with all or specific ones of said books;

said feeding step including providing at least two feeding stations each holding a supply of a different insert to be fed and selectively actuating said feeding stations to associate a selected one or more of said inserts with all or specific ones of said books; and affixing each of said inserts to a signature within one of said books at a point along said binding line.

* * * * *